US010330437B2

(12) United States Patent
Kung et al.

(10) Patent No.: US 10,330,437 B2
(45) Date of Patent: Jun. 25, 2019

(54) ROTATIONAL SIGHTING APPARATUS

(71) Applicant: VEGA FORCE INTERNATIONAL CORP., Taoyuan (TW)

(72) Inventors: Shih-Che Kung, Taoyuan (TW); Wei-Hung Chung, Taoyuan (TW)

(73) Assignee: VEGA FORCE INTERNATIONAL CORP., Taoyuan (TW)

( * ) Notice: Subject to any disclaimer, the term of this patent is extended or adjusted under 35 U.S.C. 154(b) by 0 days.

(21) Appl. No.: 15/871,069

(22) Filed: Jan. 15, 2018

(65) Prior Publication Data

US 2018/0306552 A1 Oct. 25, 2018

(30) Foreign Application Priority Data

Apr. 25, 2017 (TW) ..... 106205788 U

(51) Int. Cl.

| | |
|---|---|
| ***F41G 1/16*** | (2006.01) |
| ***F41G 1/26*** | (2006.01) |
| ***F41G 1/18*** | (2006.01) |
| ***F41G 1/08*** | (2006.01) |
| ***F41G 1/033*** | (2006.01) |

(52) U.S. Cl.

CPC ..... *F41G 1/26* (2013.01); *F41G 1/033* (2013.01); *F41G 1/08* (2013.01); *F41G 1/18* (2013.01)

(58) Field of Classification Search

CPC ..... F41G 1/08; F41G 1/16; F41G 1/17; F41G 1/18; F41G 11/003; F41G 1/02; F41G 1/033; F41G 1/06; F41G 1/065; F41G 1/10; F41G 1/12; F41G 1/14; F41G 11/005

See application file for complete search history.

(56) References Cited

U.S. PATENT DOCUMENTS

| | | | | | |
|---|---|---|---|---|---|
| 507,278 | A | * | 10/1893 | Latta | F41G 1/26 42/137 |
| 1,340,996 | A | * | 5/1920 | Williams | F41G 1/16 42/137 |
| 1,644,149 | A | * | 10/1927 | Redfield | F41G 1/16 42/136 |
| 1,908,019 | A | * | 5/1933 | Howard | F41G 1/17 42/139 |
| 2,229,637 | A | * | 1/1941 | Burton | F41G 1/24 42/137 |

(Continued)

*Primary Examiner* — Derrick R Morgan

(74) *Attorney, Agent, or Firm* — Chun-Ming Shih; HDLS IPR Services

(57) ABSTRACT

A rotational sighting apparatus includes a base, an aiming member and a pressing pivotal axle. The base includes a main body, a side cover and a through hole formed on the side cover. The side cover further includes a locking portion adjacent to the through hole. The aiming member includes a rotating portion and a pivotal attachment hole formed to penetrate through the rotating portion. The pressing pivotal axle penetrates through the pivotal attachment hole to connect with the rotating portion via the through hole. The pressing pivotal axle includes a locking key moveably locked onto the locking portion and an elastic element configured to drive the pressing pivotal axle to rotate. Accordingly, when the locking key disengages from the locking portion, the elastic element drives the pressing pivotal axle to allow the aiming element to rotate from a first position to a second position.

13 Claims, 8 Drawing Sheets

(56) References Cited

U.S. PATENT DOCUMENTS 2,336,108 A * 12/1943 Lowe ..... F41G 1/18 42/137
2,367,762 A * 1/1945 Eiane ..... F41G 1/033 42/148
2,486,400 A * 11/1949 Garand ..... F41G 1/26 42/137
2,585,933 A * 2/1952 Harvey ..... F41G 1/17 42/137
3,930,316 A * 1/1976 Tellie ..... F41G 1/08 42/140
5,577,326 A * 11/1996 Montelin ..... F41G 1/16 356/251
6,779,290 B1 * 8/2004 Houtsma ..... F41G 1/08 42/111
7,814,699 B2 * 10/2010 Storch ..... F41G 1/17 42/137
7,908,782 B1 * 3/2011 LaRue ..... F41G 11/008 42/124
7,946,074 B2 * 5/2011 Nemec ..... F41G 1/01 42/113
8,015,744 B1 * 9/2011 Swan ..... F41G 1/065 42/133
8,069,607 B2 * 12/2011 Ballard ..... F41G 1/033 42/111
8,468,735 B1 * 6/2013 Keng ..... F41G 11/004 42/148
D733,250 S * 6/2015 Hu ..... D22/109
9,322,615 B2 * 4/2016 Raybman ..... F41G 1/17
9,683,811 B1 * 6/2017 Warensford ..... F41G 1/16
9,733,045 B1 * 8/2017 Bozek ..... F41G 1/16
9,733,046 B1 * 8/2017 Bozek ..... F41G 1/16
9,823,044 B1 * 11/2017 Cabrera ..... F41G 1/17
D807,464 S * 1/2018 Warensford ..... D22/109
9,976,834 B1 * 5/2018 Cheng ..... F41G 1/04
10,030,935 B1 * 7/2018 Ding ..... F41G 1/01
10,036,611 B1 * 7/2018 Bozek ..... F41G 1/16
10,119,784 B1 * 11/2018 Ding ..... F41G 1/033
2002/0152664 A1 * 10/2002 Mendoza-Orozco ..... F41G 1/26 42/137
2005/0188602 A1 * 9/2005 Swan ..... F41G 1/065 42/147
2006/0218841 A1 * 10/2006 Campean ..... F41G 1/383 42/129
2009/0038202 A1 * 2/2009 Nemec ..... F41G 1/01 42/137
2009/0049734 A1 * 2/2009 Storch ..... F41G 1/08 42/136
2011/0047855 A1 * 3/2011 Wong ..... F41G 11/002 42/124
2011/0167703 A1 * 7/2011 Deros ..... F41G 11/003 42/90
2011/0247257 A1 * 10/2011 Hopkins ..... F41G 1/08 42/133
2011/0283590 A1 * 11/2011 Chiang ..... F41G 11/003 42/124
2011/0308132 A1 * 12/2011 Hewes ..... F41G 1/033 42/135
2011/0308133 A1 * 12/2011 Nemec ..... F41G 1/16 42/137
2012/0180365 A1 * 7/2012 Savoy ..... F41G 11/003 42/90
2013/0036650 A1 * 2/2013 Larue ..... F41G 11/003 42/148
2013/0312307 A1 * 11/2013 Rorick ..... F41C 27/00 42/90
2013/0312309 A1 * 11/2013 Rorick ..... F41G 11/003 42/114
2014/0047755 A1 * 2/2014 McClintock ..... F41C 27/00 42/90
2015/0198414 A1 * 7/2015 Raybman ..... F41G 1/17 42/111
2016/0209166 A1 * 7/2016 Larson, Jr. ..... F41G 11/003
2017/0146318 A1 * 5/2017 Plummer ..... F41G 1/345

* cited by examiner

ROTATIONAL SIGHTING APPARATUS

BACKGROUND OF THE INVENTION

Field of the Invention

The technical field relates to a sighting apparatus, in particular, to a rotational sighting apparatus using a press method to rotate an aiming member to a vertical position.

Description of Related Art

Survival entertainment games are becoming more popular nowadays, and such games emphasize on the sports rules, teamwork and physical training etc. in order to allow the game players to benefit from physical exercises of the games and to develop personal relationship with the teammates while encouraging advantageous sprits and challenging minds. Therefore, such games show increasing trend in recent years in terms of both the number of players and the industrial manufacturers. Toy guns are often used in survival entertainment games by players for precise aiming at targets for shooting, and the sighting mechanism thereof is also a crucial part of the design of such toy guns.

In general, a toy gun is typically designed to simulate a real gun, and the sighting system used by either an actual gun or a toy gun mainly comprises a front sight and a rear sight, which are arranged in a straight line on the gun barrel. When the user uses the rear sight close to his eyes to align with the front sight and to further align with a target in a straight line among these three points, the aiming action is then complete. Since the current sighting mechanisms, such as front and rear sights, of toy or actual guns are typically not equipped with the automatic or semi-automatic rotational function such that their uses or operations are inconvenient. In addition, the molds for manufacturing the front and rear sight bases vary among different guns without standardized designs; therefore, the cost of sighting mechanisms typically made of plastic or similar materials cannot be effectively reduced.

In view of the above, the inventor seeks to overcome the aforementioned drawbacks, and after years of researches along with the utilization of scientific principles, the inventor provides a novel design of the present invention in order to overcome the aforementioned drawbacks.

SUMMARY OF THE INVENTION

An objective of the present invention is to provide a rotational sighting apparatus with facilitated operation and capable of using a press method to automatically rotate an aiming member to a vertical position.

To achieve the aforementioned objective, the present invention provides a rotational sighting apparatus, comprising a base, an aiming member and a pressing pivotal axle. The base comprises a main body, a side cover assembled onto the main body, a through hole formed on the side cover and a pivotal attachment space formed between the main body and the side cover; wherein the side cover further includes a locking portion adjacent to the through hole. The aiming member includes a rotating portion received inside the pivotal attachment space and a pivotal attachment hole formed to penetrate through the rotating portion. The pressing pivotal axle penetrates through the pivotal attachment hole to connect with the rotating portion via the through hole. The pressing pivotal axle includes a locking key moveably locked onto the locking portion and an elastic element configured to drive the pressing pivotal axle to rotate; wherein when the locking key disengages from the locking portion, the elastic element drives the pressing pivotal axle to allow the aiming element to rotate from a first position to a second position.

Preferably, according to an exemplary embodiment of the present invention, wherein the rotating portion further includes a slot for retaining the locking slot, and the locking slot is configured to rotatably drive the slot and to allow the aiming element to rotate together therewith.

Preferably, according to an exemplary embodiment of the present invention, wherein the locking key is arranged at an outer circumferential surface of the pressing pivotal axle, and the side cover further includes a protruding ring arranged to face toward the pivotal attachment space; the locking portion is installed on the protruding ring.

Preferably, according to an exemplary embodiment of the present invention, wherein a length of the locking key is smaller than a length of the pressing pivotal axle; the locking key is a protruding rib, and the locking portion is a cut-out slot.

Preferably, according to an exemplary embodiment of the present invention, wherein the pressing pivotal axle includes a receiving slot for receiving the elastic element therein; one end of the elastic element is secured inside the receiving slot and another end thereof protrudes out of the receiving slot to be locked onto the base.

Preferably, according to an exemplary embodiment of the present invention, wherein the elastic element is a compression helical spring, and one end of the compression helical spring is locked onto a locking slot of the pressing pivotal axle.

Preferably, according to an exemplary embodiment of the present invention, wherein the first position refers to a horizontal state parallel to the base, and the second position refers to a vertical state perpendicular to the base.

Preferably, according to an exemplary embodiment of the present invention, wherein the aiming member is a rear sight; the rear sight is located on top of the rotating portion and further comprises a wind deviation adjustment structure and a peep-hole switch structure.

Preferably, according to an exemplary embodiment of the present invention, wherein the wind deviation adjustment structure comprises a rotating axle pivotally attached onto the peep-hole switch structure and an adjustment nut configured to rotate the rotating axle for positioning thereof.

Preferably, according to an exemplary embodiment of the present invention, wherein the aiming member further comprises a positioning pin and a compression spring abutted against the positioning pin; the adjustment nut including a plurality of positioning holes formed thereon and arranged opposite to the positioning pin in order to allow the adjustment nut to drive the rotating axle to rotate and to be positioned at any one of the positioning holes.

Preferably, according to an exemplary embodiment of the present invention, wherein the peep-hole switch structure comprises a first peep-hole member and a second peep-hole member rotatably assembled onto the first peep-hole member; the first peep-hole member and the second peep-hole member includes a first peep hole and a second peep hole formed thereon respectively.

Preferably, according to an exemplary embodiment of the present invention, wherein the aiming member is a front sight, and the front sight further includes a front sight column arranged on top of a center of the rotating portion.

The present invention is also of the following technical effects. The aiming member of the present invention provides commonly applicable front and rear sights such that only one set of molds is used; therefore, the cost can be effectively reduced. In addition, players can also change the use of the first peep hole of the first peep-hole member or the second peep hole of the second peep-hole member depending upon the selection needs. When the second peep hole of the second peep-hole member is selected for use, the second peep hole of the second peep-hole member can be conveniently and rotatably inserted into the first peep hole.

DETAILED DESCRIPTION OF THE INVENTION

The following provides a detailed technical content of the present invention along with the accompanied drawings. However, the accompanied drawings are provided for reference and illustrative purpose only such that they shall not be used to limit the scope of the present invention.

As shown in FIG. 1 to FIG. 6 the present invention provides a rotational sighting apparatus 100, comprising a base 110, an aiming member 130 and a pressing pivotal axle 150. According to first exemplary embodiment of the present invention, the rotational sighting apparatus 100 is preferably applicable to various types of toy guns, and the base 110, the aiming member 130 and the pressing pivotal attachment axle 150 are preferably made of plastic, plastic steel or other similar materials in order to reduce the weight and the manufacturing cost. However, in other different embodiments, the rotational sighting apparatus 100 can also be applied to a real gun, rather than a toy gun, and its material includes plastic, iron or metal alloys.

Figure 2:
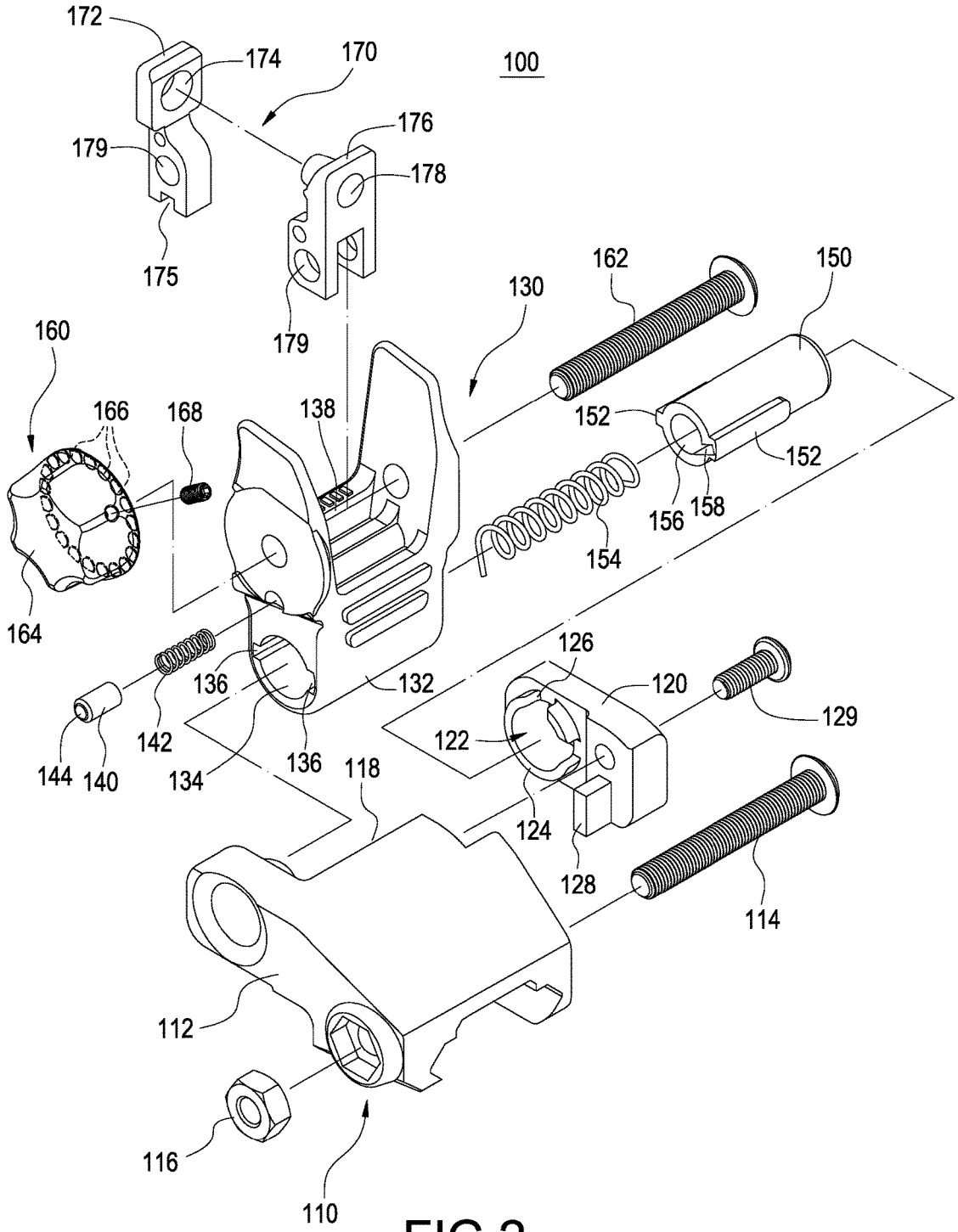
FIG. 2 is an exploded view of the rotational sighting apparatus according to the first exemplary embodiment of the present invention.

As shown in the drawings, the base 110 comprises a main body 112, a side cover 120 assembled onto the main body 112, a through hole 122 formed on a side cover 120 and a pivotal attachment space 118 formed between the main body 112 and the side cover 120. In the exemplary embodiment as shown in FIG. 2, the main body 112, preferably uses a pivotal axle 114 and an attachment element 116, such as the fixation elements of bolt and nut etc., installed at the upper edge of the gun barrel (not shown in the drawings). The side cover 120 further includes a positioning block 128 arranged at one side opposite from the main body 112 in order to be positioned and assembled onto the main body 112, followed by using an attachment element 129, such as a bolt, for fastening the side cover 120 onto one side of the main body 112.

The side cover 120 further includes a locking portion 126 formed adjacent to the through hole 122. The aiming member 130 includes a rotating portion 132 received inside the pivotal attachment space 118 and a pivotal attachment hole 134 penetrating through the rotating portion 132. The pressing pivotal axle 150 penetrates through the pivotal attachment hole 134 via the through hole 122 in order to connect with the rotating portion 132. The pressing pivotal axle 150 includes a locking key 152 moveably locked with the locking portion 126 and an elastic element 154 capable of driving the pressing pivotal attachment 150 to rotate. The pivotal attachment hole 134 of the rotating portion 132 further includes a slot 136 formed therein and provided for retaining the locking key 152 in order to allow the locking key 152 to rotatably drive the slot 136 and to allow the aiming member 130 to rotate together therewith.

In the exemplary embodiment of the present invention as shown in FIG. 2, the two symmetrically arranged locking keys 152 are preferably formed on the outer circumferential surface of the pressing pivotal axle 150. The side cover 120 further includes a protruding ring 124 arranged to face toward the pivotal attachment space 118, and the two locking portions 126 corresponding to the two locking keys 152 are arranged on the protruding ring 124. The lengths of the two locking keys 152 are smaller than the length of the pressing pivotal axle 150, and the two locking keys 152 are preferably protruding ribs, and the two locking portions 126 are preferably cut-out slots. When the two locking keys 152 of the pressing pivotal axle 150 are retained inside the two locking portions 126 of the side cover 120 (the pressing pivotal axle 150 is protruded out of the side cover 120), the two locking keys 152 are engaged with the two locking portions 126 in exact. When the two locking keys 152 disengage from the two locking portions 126 (the pressing pivotal axle 150 is moved into the side cover 120), the two locking keys 152 are separated from the two locking portions 126.

The pressing pivotal axle 150 includes a receiving slot 156 provided for receiving the elastic element 154 therein. One end of the elastic element 154 is secured inside the receiving slot 156, and another end thereof protrudes out of the receiving slot 156 and is locked onto the base 112. As shown in FIG. 2, the elastic unit 154 is preferably a compression helical spring. One end of the compression helical spring is positioned and locked onto a locking slot 158 of the pressing attachment axle 150 such that when the pressing pivotal axle 150 is rotated, the elastic element 154 is able to store an elastic reaction force for rotations.

Figure 3:
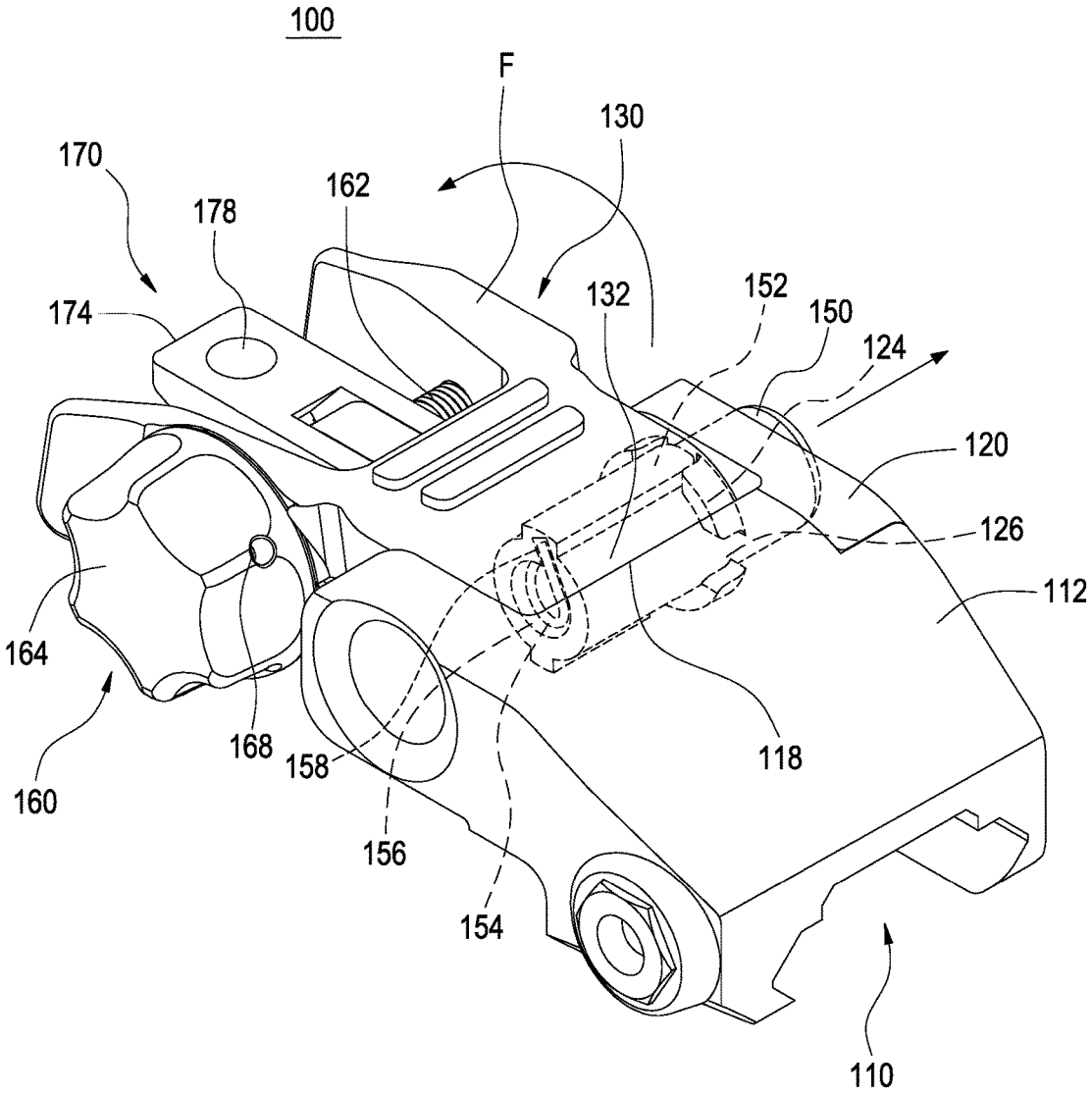
FIG. 3 is a perspective view of the rotational sighting apparatus according to the first exemplary embodiment of the present invention under the first position.
Figure 4:
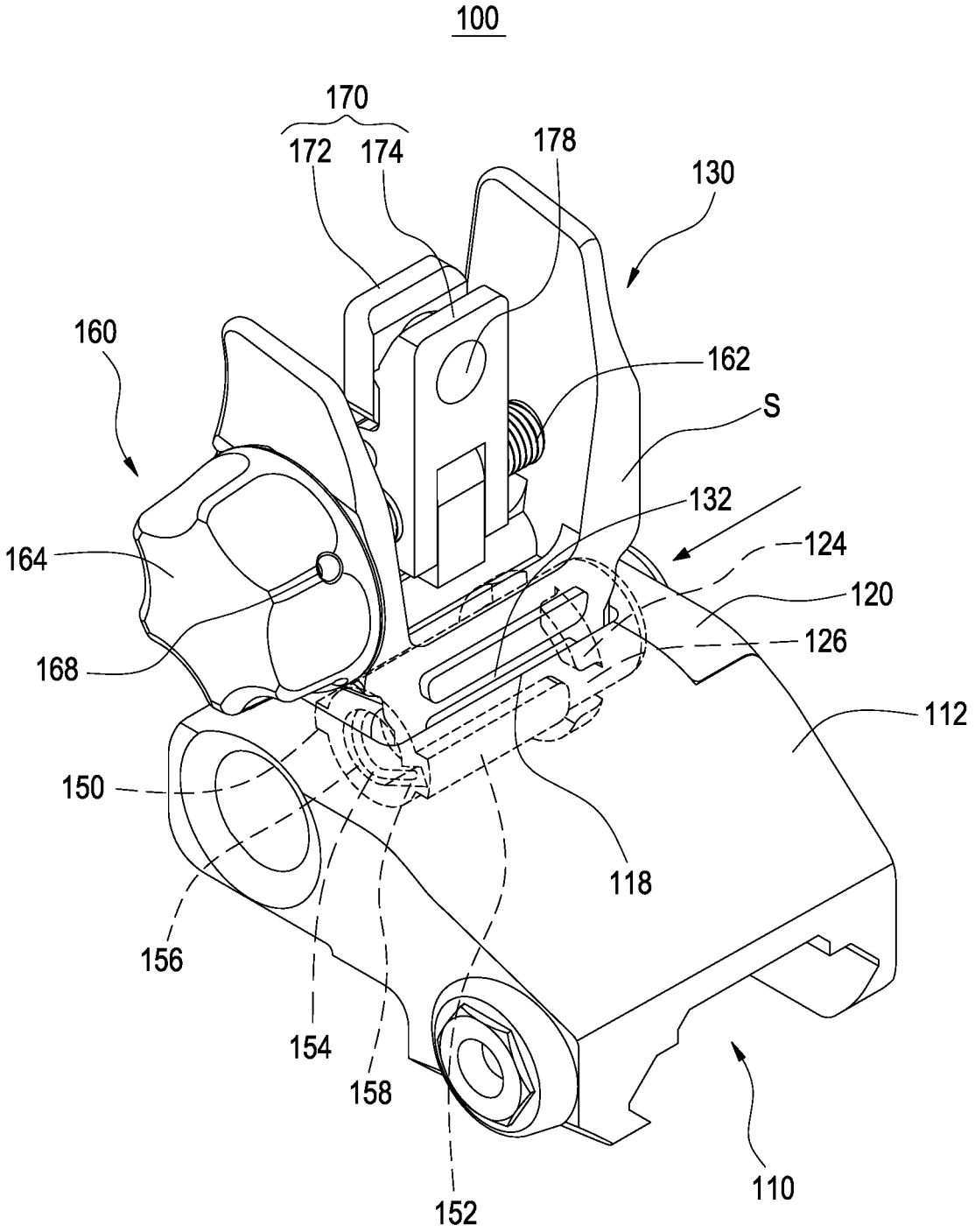
FIG. 4 is a perspective view of the rotational sighting apparatus according to the first exemplary embodiment of the present invention under the second position.

In an actual operation, when the locking key 152 of the pressing pivotal axle 150 is pressed to move and disengage from the locking portion 126 of the side cove 120, the elastic element 154 is able to drive the pressing pivotal axle 150 in order to allow the aiming member 130 to rotate from a first position F to a second position S, as shown in FIG. 3 and FIG. 4. In other words, the user only needs to press the pressing pivotal axle 150 toward the direction of the main body 112 by a small moving distance and to allow it to be locked in position with the inner ring (not shown in the drawings) of the main body 112. Since the locking key 152 of the pressing pivotal axle 150 is no longer restricted by the locking portion 126, the elastic element 154 is able to release its elastic reaction force stored in order to allow the first position F of a horizontal state being originally parallel to the base 10 to be rotated to the second position S of a vertical state perpendicular to the base 110.

Figure 1:
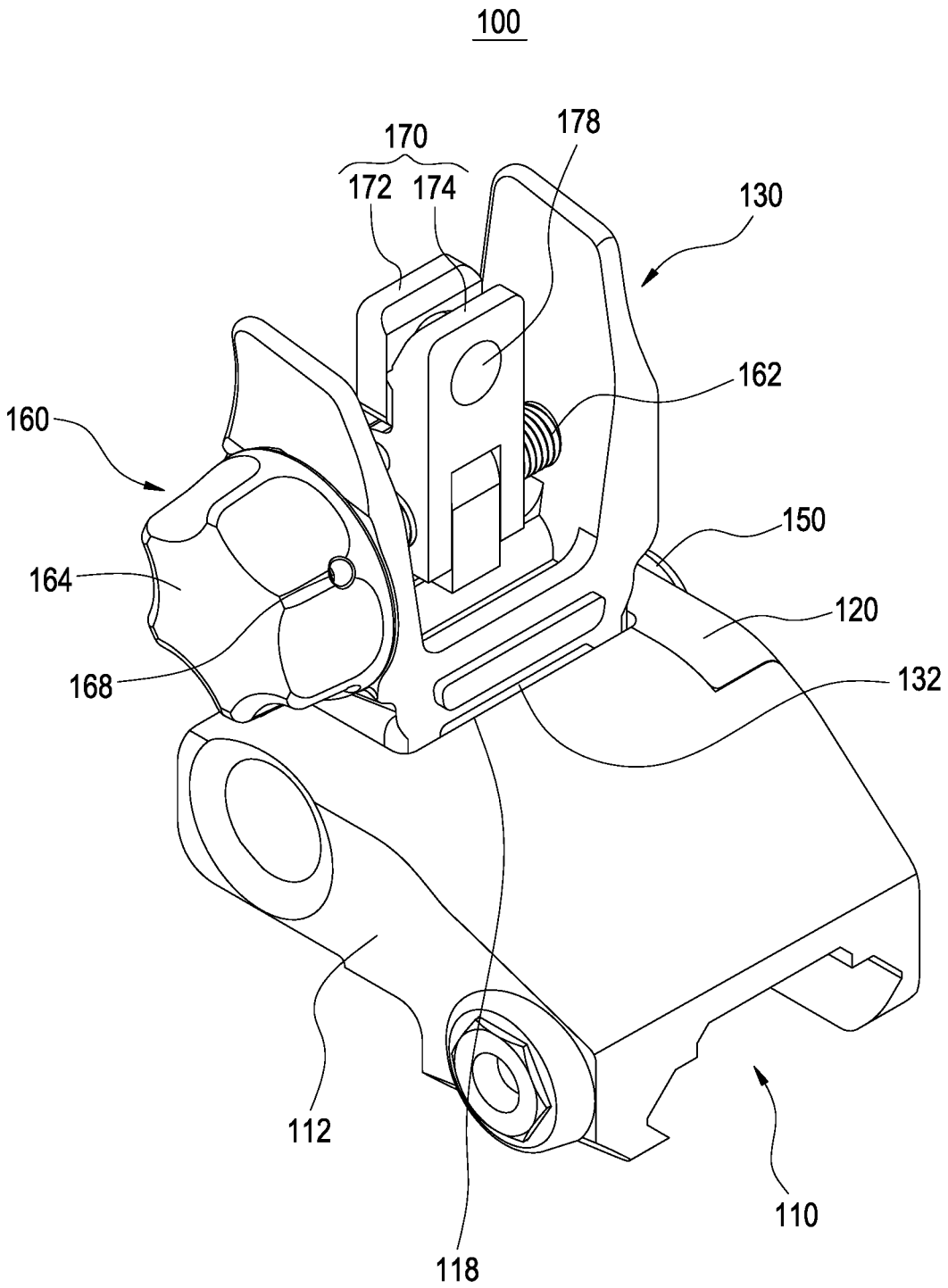
FIG. 1 is a perspective view of the rotational sighting apparatus according to the first exemplary embodiment of the present invention.

When there is no need to use the sight or when it is not use, the user can manually rotate the aiming member 130 from the second position S to the first position F. At this time, the pressing pivotal axle 150 is able to disengage from the inner ring (not shown in the drawings), and the elastic element 154 arranged inside the pressing pivotal axle 150 can also spring back to allow the pressing pivotal axle 150 to return to the position, as shown in FIG. 1 or FIG. 3, in order to achieve the objective of storing the aiming member 130. Therefore, the rotational sighting apparatus 100 according to this exemplary embodiment of the present invention is of facilitated and quick operations, and the aiming member 130 can also be rotated to a vertical position automatically in order to achieve the effect of quick aiming and shooting operation.

In the first embodiment, the aiming member 130 is preferably a rear sight. As shown in FIG. 1 to FIG. 6, the rear sight is located on top of the rotating portion 132, and it further comprises a wind deviation adjustment structure 160 and a peep-hole switch structure 170.

The wind deviation adjustment structure 160 comprises a rotating axle 162 pivotally attached onto the peep-hole switch structure 170 and an adjustment nut 164 capable of rotating the rotating axle 160 for positioning. As shown in the drawings, the rotating axle 162 is preferably a bolt. The aiming member 130 further comprises a positioning pin 140 for positioning the adjustment nut 164 and a compression spring 142 abutted against the positioning pin 140. The inner circumferential surface of the adjustment nut 164 includes a plurality of positioning holes 166 formed thereon and opposite from the positioning pin 140 in order to allow the adjustment nut 164 to drive the rotating axle 162 to rotate and to be positioned at any one of the positioning hole 166.

As shown in FIG. 2, one side of the adjustment nut 164 is further installed with a headless screw 168 for fastening in the rotating axle 162 in order to ensure that the adjustment nut 164 is able to operably rotate the rotating axle 162 and to allow the peep-hole switch structure 170 to move horizontally to the left or right on the aiming member 130. To allow the adjustment nut 164 to be stable to provide excellent operation feeling, one end surface of the positioning pin 140 is preferably formed of an arc surface 144, and each of the positioning holes 166 is also formed of arc surface 144 correspondingly (not shown in the drawings). Therefore, when the adjustment nut 164 is rotated relative to the positioning pin 140, each positioning hole 166 is able to pass by the elastic contact of the positioning pin 140 in order to generate tiny positioning click sound.

Figure 5:
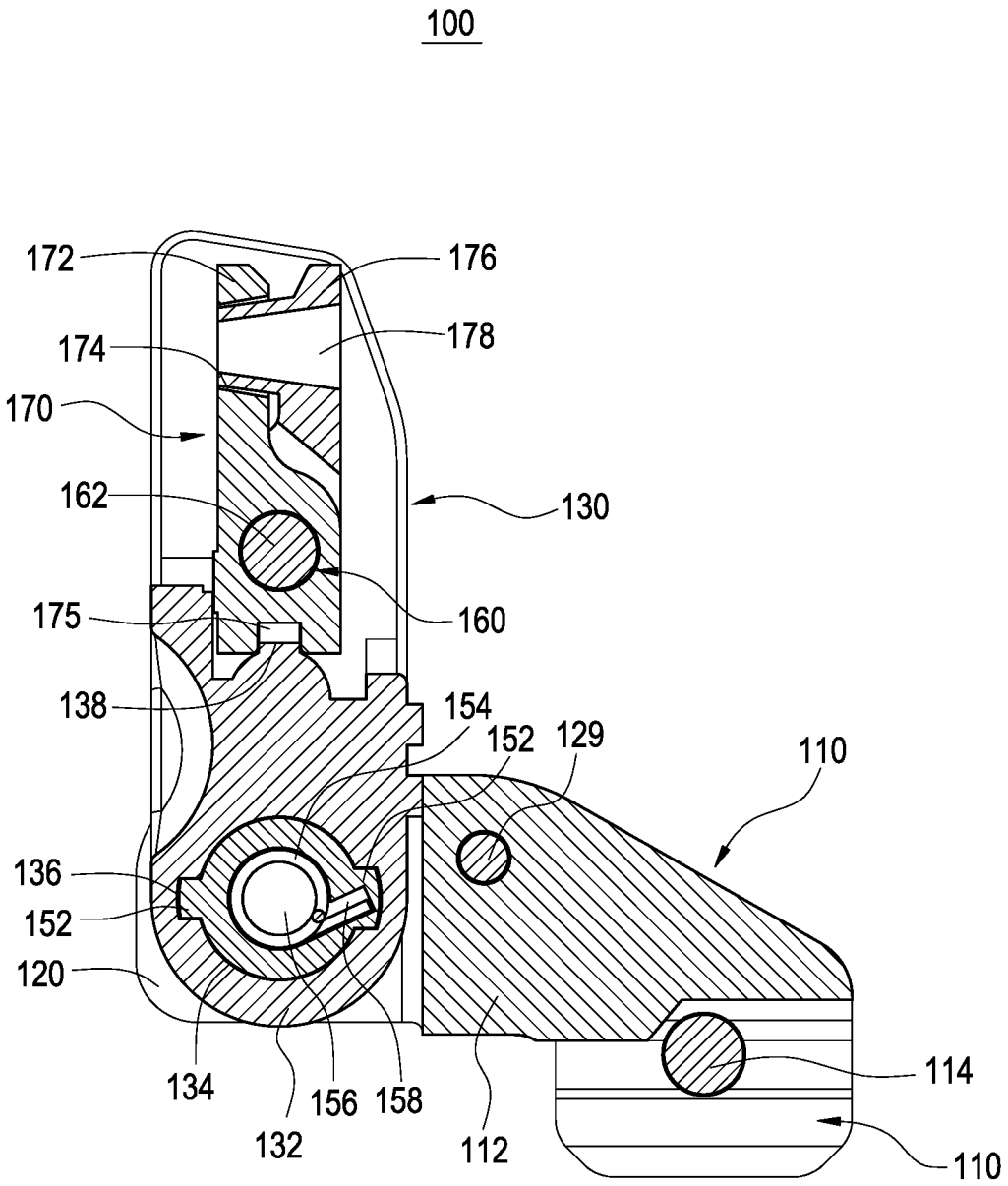
FIG. 5 is a cross sectional view of the rotational sighting apparatus according to the first exemplary embodiment of the present invention.
Figure 6:
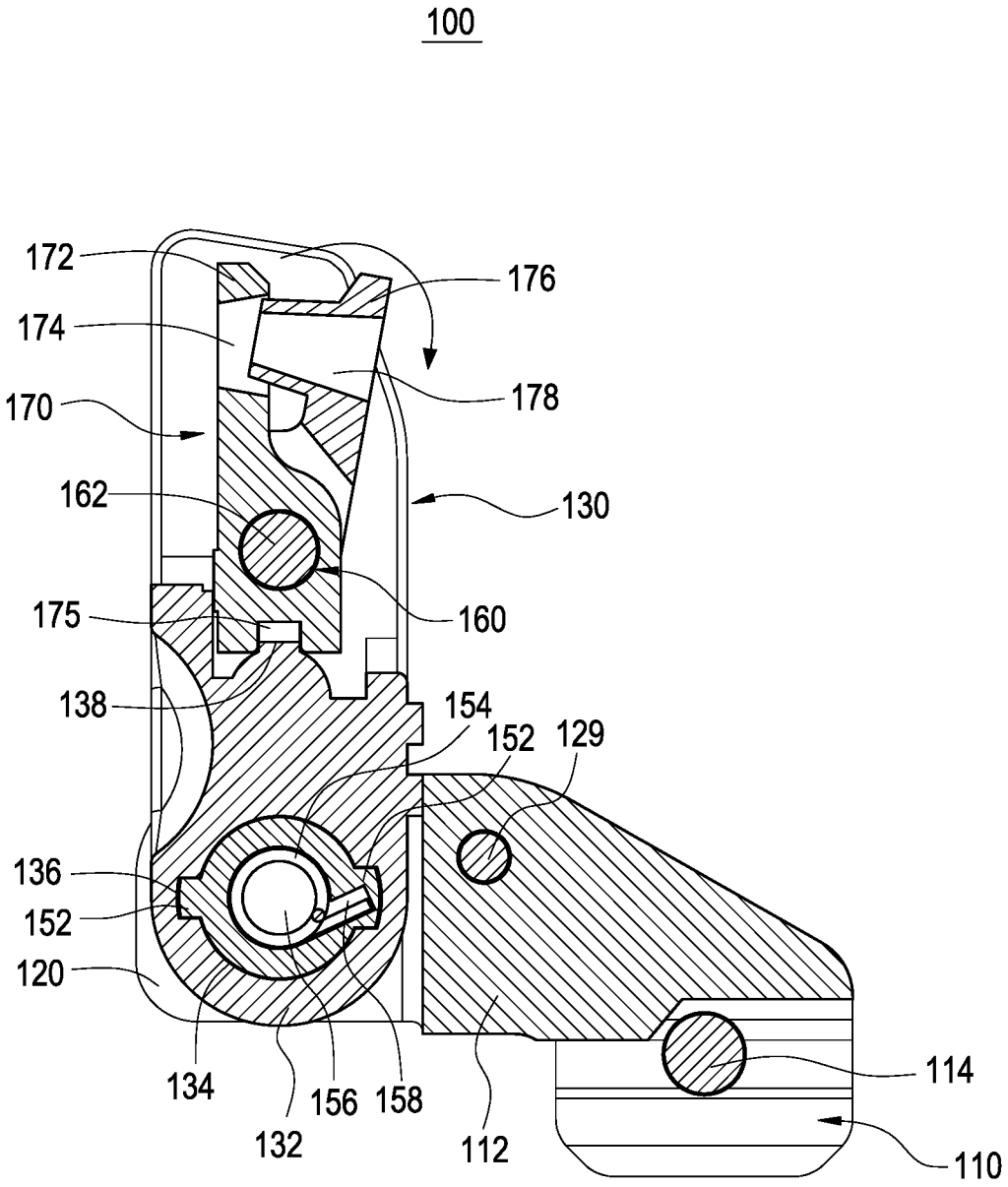
FIG. 6 is another cross sectional view of the rotational sighting apparatus according to the first exemplary embodiment of the present invention.

Furthermore, please refer to FIG. 5 and FIG. 6. The peep-hole switch structure 170 comprises a first peep-hole member 172 and a second peep-hole member 176 rotatably assembled onto the first peep-hole member 172. The first peep-hole member 172 and the second peep-hole member 176 include a first peep hole and a second peep hole 178 formed thereon respectively. In addition, the first peep hole 174 and the second peep hole 178 are preferably of conical holes, and a length of the first peep hole 174 is smaller than a length of the second peep hole 178.

In the exemplary embodiment as shown in FIG. 2, the first peep-hole member 172 and the second peep-hole member 174 are formed of through holes 179 thereon and provided for the rotating axle 162 to be pivotally attached thereto in order to allow the first peep-hole member 172 and the second peep-hole member 176 to move left or right along with the rotation of the rotating axle 162. In particular, the bottom end of the first peep-hole member 172 further includes a guiding slot 175 formed thereon, and the guiding slot 175 is arranged to cross over a track 138 on the aiming member 130. Therefore, when the user has the need to rotate the adjustment nut 160, the first peep-hole 172 and the second peep-hole 176 are able to move left or right along with the rotation of the rotating axle 162.

It shall be noted that the second peep-hole member 176 further uses the rotating axle 162 as the center to rotate relative to the first peep-hole member 172. The user can choose and switch the use of the first peep hole 172 of the first peep-hole member 174 or the second peep hole 178 of the second peep-hole member 176 depending upon the needs. When the second peep hole 178 of the second peep-hole member 176 is selected for use, the second peep hole 178 of the second peep-hole member 176 can be rotatably inserted into the second peep hole 174. In general, the length of the first peep hole 174 is relatively shorter such that it is suitable for the aiming of a target at a short distance or a moving target; and the length of the second peep hole 178 is relatively longer such that it is suitable for the aiming of a target at a long distance or a motionless target.

Figure 7:
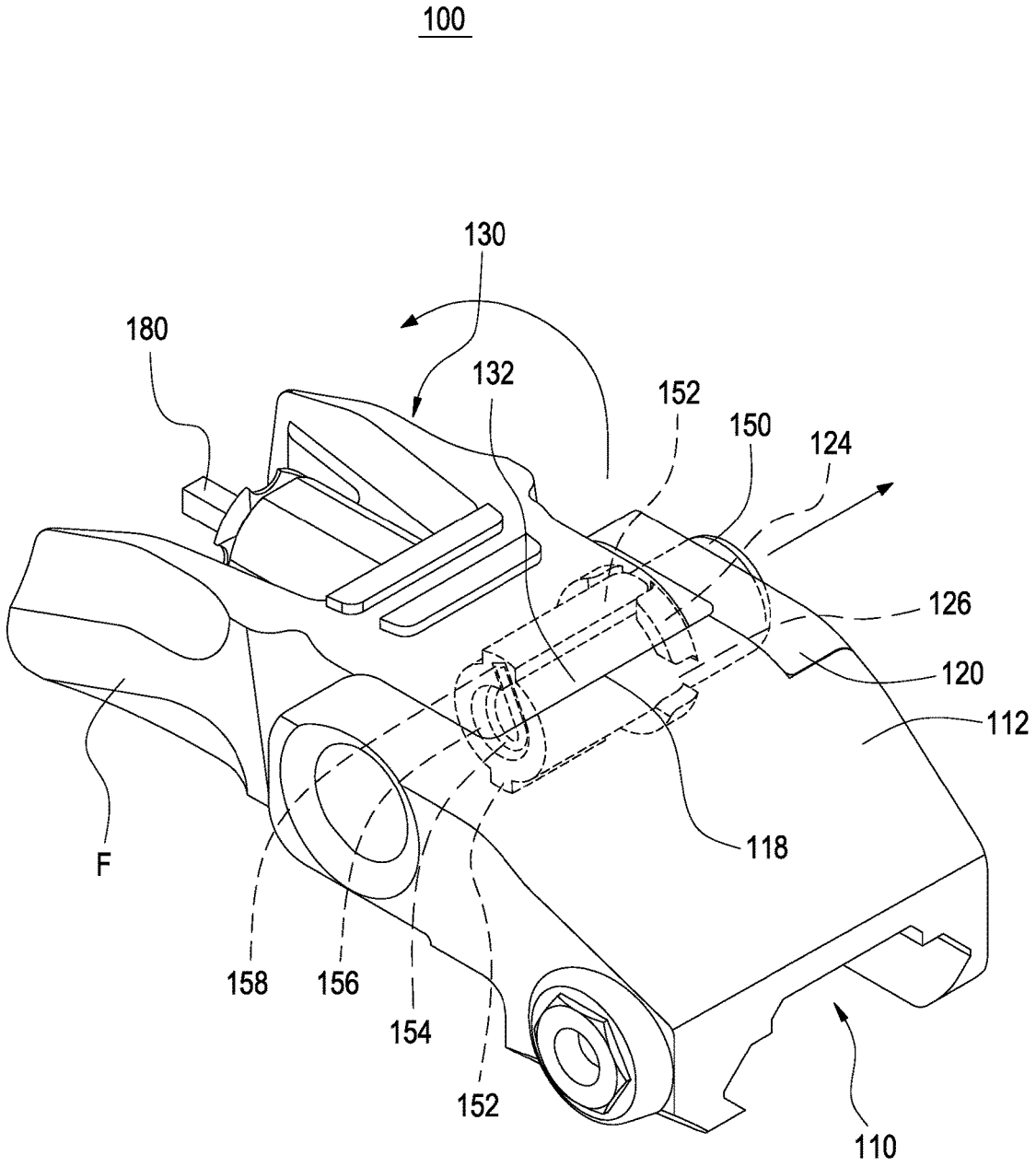
FIG. 7 is a perspective view of the rotational sighting apparatus according to the second exemplary embodiment of the present invention under the first position.
Figure 8:
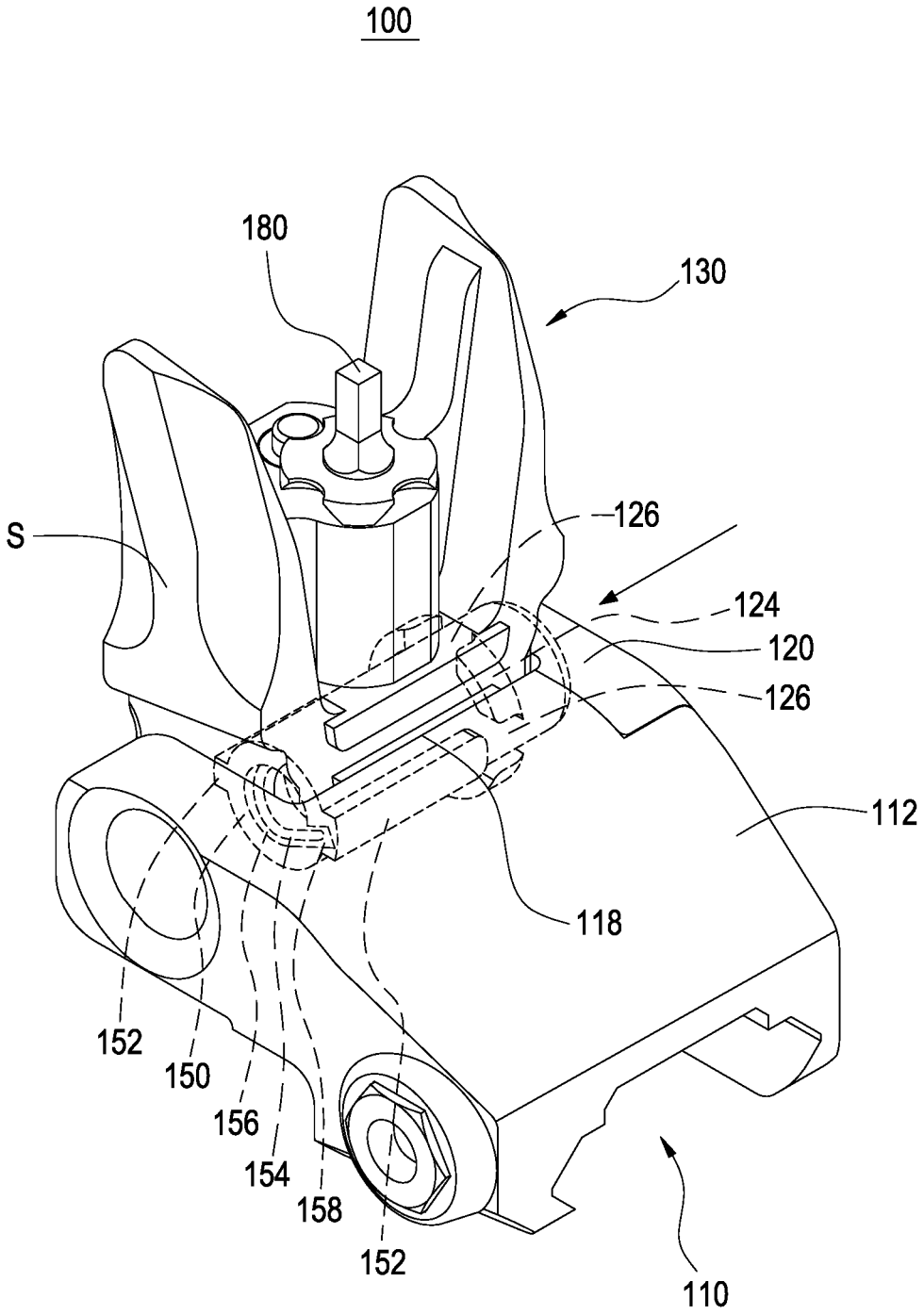
FIG. 8 is a perspective view of the rotational sighting apparatus according to the second exemplary embodiment of the present invention under the second position.

Please refer to FIG. 7 and FIG. 8, showing two perspective views of different states of a rotational sighting apparatus according to a second exemplary embodiment of the present invention. The main difference between this second exemplary embodiment and the previously mentioned first exemplary embodiment of the present invention is that the aiming member 130 is preferably a front sight. The front sight further includes a front sight column 180 arranged on top of a center of the rotating portion 132 in order to provide the aiming function to the user. The rest of the elements, structure and operation method of this second exemplary embodiment are identical to those of the previously mentioned first exemplary embodiment of the present invention; therefore, the details thereof are omitted hereafter.

Accordingly, in the exemplary embodiments of the present invention, the aiming member 130 can be used for the rear sight or the front sight depending upon the needs at the same time such that it only requires the use of one set of mold for manufacturing; therefore, the cost of the rotational sighting apparatus of the present invention can be effectively reduced.

The above describes the preferable and feasible exemplary embodiments of the present invention for illustrative purposes only, which shall not be treated as limitations of the scope of the present invention. Any equivalent changes and modifications made in accordance with the scope of the claims of the present invention shall be considered to be within the scope of the claim of the present invention.

What is claimed is:

1. A rotational sighting apparatus, comprising:

a base comprising a main body, a side cover assembled onto the main body, a through hole formed on the side cover and a pivotal attachment space formed between the main body and the side cover; wherein the side cover further includes a locking portion adjacent to the through hole;

an aiming member having a rotating portion received inside the pivotal attachment space and a pivotal attachment hole formed to penetrate through the rotating portion; and a pressing pivotal axle penetrating through the pivotal attachment hole to connect with the rotating portion via the through hole; the pressing pivotal axle having a locking key moveably locked with the locking portion;

wherein the pressing pivotal axle includes a receiving slot provided for receiving an elastic element therein; one end of the elastic element is secured inside a locking slot on the pressing pivotal axle; the locking slot is an indented portion formed within at least a portion of the locking key and the locking slot communicates with the receiving slot; when the pressing pivotal axle is rotated, the elastic element stores an elastic rotational reaction force; and wherein when the pressing pivotal axle is pressed such that the locking key moves and disengages from the locking portion of the side cover, the elastic element releases the elastic rotational reaction force and causes the pressing pivotal axle to rotate such that the aiming member to rotates from a first position to a second position.

2. The rotational sighting apparatus according to claim 1, wherein the rotating portion further includes a slot for retaining the locking key, and the locking key is configured to rotate to drive the slot and to allow the aiming element to rotate together therewith.

3. The rotational sighting apparatus according to claim 1, wherein the locking key is arranged at an outer circumferential surface of the pressing pivotal axle, and the side cover further includes a protruding ring arranged to face toward the pivotal attachment space; the locking portion is a notched section of the protruding ring.

4. The rotational sighting apparatus according to claim 1, wherein a length of the locking key is smaller than a length of the pressing pivotal axle; the locking key is a protruding rib, and the locking portion is a cut-out slot.

5. The rotational sighting apparatus according to claim 2, wherein a length of the locking key is smaller than a length of the pressing pivotal axle; the locking key is a protruding rib, and the locking portion is a cut-out slot.

6. The rotational sighting apparatus according to claim 3, wherein a length of the locking key is smaller than a length of the pressing pivotal axle; the locking key is a protruding rib, and the locking portion is a cut-out slot.

7. The rotational sighting apparatus according to claim 1, wherein the elastic element is a compression helical spring.

8. The rotational sighting apparatus according to claim 1, wherein the first position refers to a horizontal state parallel to the base, and the second position refers to a vertical state perpendicular to the base.

9. The rotational sighting apparatus according to claim 1, wherein the aiming member is a rear sight; the rear sight is located on top of the rotating portion and further comprises a wind deviation adjustment structure and a peep-hole switch structure.

10. The rotational sighting apparatus according to claim 9, wherein the wind deviation adjustment structure comprises a rotating axle pivotally attached onto the peep-hole switch structure and an adjustment nut configured to rotate the rotating axle for positioning thereof.

11. The rotational sighting apparatus according to claim 10, wherein the aiming member further comprises a positioning pin and a compression spring abutted against the positioning pin; the adjustment nut including a plurality of positioning holes formed thereon and arranged opposite to the positioning pin in order to allow the adjustment nut to drive the rotating axle to rotate and to be positioned at any one of the positioning holes.

12. The rotational sighting apparatus according to claim 9, wherein the peep-hole switch structure comprises a first peep-hole member and a second peep-hole member rotatably assembled onto the first peep-hole member; the first peep-hole member and the second peep-hole member includes a first peep hole and a second peep hole formed thereon respectively, and wherein when the second peep hole of the second peep-hole member is selected for use, the second peep hole of the second peep-hole member can be rotatably inserted into the second peep hole.

13. The rotational sighting apparatus according to claim 1, wherein the aiming member is a front sight, and the front sight further includes a front sight column arranged on top of a center of the rotating portion.

* * * * *